United States Patent [19]

Murakami et al.

[11] Patent Number: 4,836,864

[45] Date of Patent: Jun. 6, 1989

[54] METHOD OF GAS CARBURIZING AND HARDENING

[75] Inventors: Koji Murakami, Settsu; Tsunao Shima, Ikoma; Yoshikazu Shimosato, Yahata; Akira Yokoyama, Okayama, all of Japan

[73] Assignee: Chugai Ro Co., Ltd., Japan

[21] Appl. No.: 911,738

[22] Filed: Sep. 26, 1986

Related U.S. Application Data

[63] Continuation of Ser. No. 686,207, Dec. 26, 1984, abandoned.

[30] Foreign Application Priority Data

Dec. 27, 1983 [JP] Japan ..... 58-247174

[51] Int. Cl.[4] ..... C21D 1/74

[52] U.S. Cl. ..... 148/16.5; 148/143

[58] Field of Search ..... 148/16.5, 16, 16.6, 148/19, 20.3, 143

[56] References Cited

U.S. PATENT DOCUMENTS 3,356,541 12/1967 Cullen ..... 266/252

3,662,996 5/1972 Schwaln et al. ..... 748/16.5

FOREIGN PATENT DOCUMENTS 6827 1/1979 Japan ..... 148/16.6

577254 10/1977 U.S.S.R. ..... 148/16.6

730875 5/1980 U.S.S.R. ..... 148/16.5

765379 9/1980 U.S.S.R. ..... 148/16.6

779440 11/1980 U.S.S.R. ..... 148/16.6

OTHER PUBLICATIONS

Making, Shaping and Treating of Steel, Ninth ed., 1971, pp. 307, 308.

Shubin R. P., "Modern Trends in Heat Treatment Technologs", Heat Treatment Technology, Aug. 1974, pp. 668–673.

*Primary Examiner*—Christopher W. Brody

*Attorney, Agent, or Firm*—Jackson & Jones

[57] ABSTRACT

A method of gas carburizing and hardening a steel article and a continuous furnace therefor. The method includes the steps of carburizing the article in a carburizing atmosphere at atmospheric pressure, heating the article in a vacuum for a predetermined period of time, and hardening the article.

3 Claims, 4 Drawing Sheets

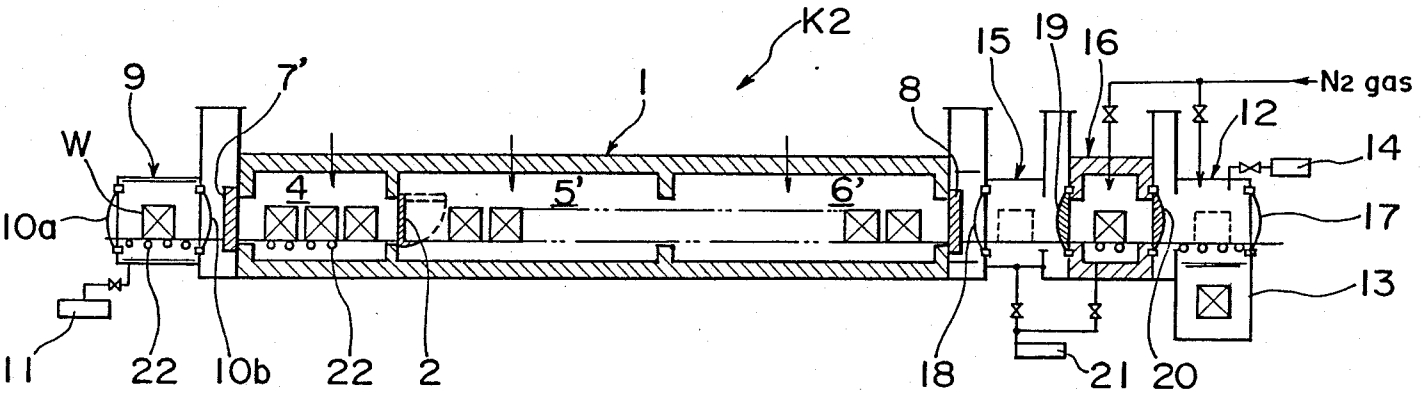
Fig. 6
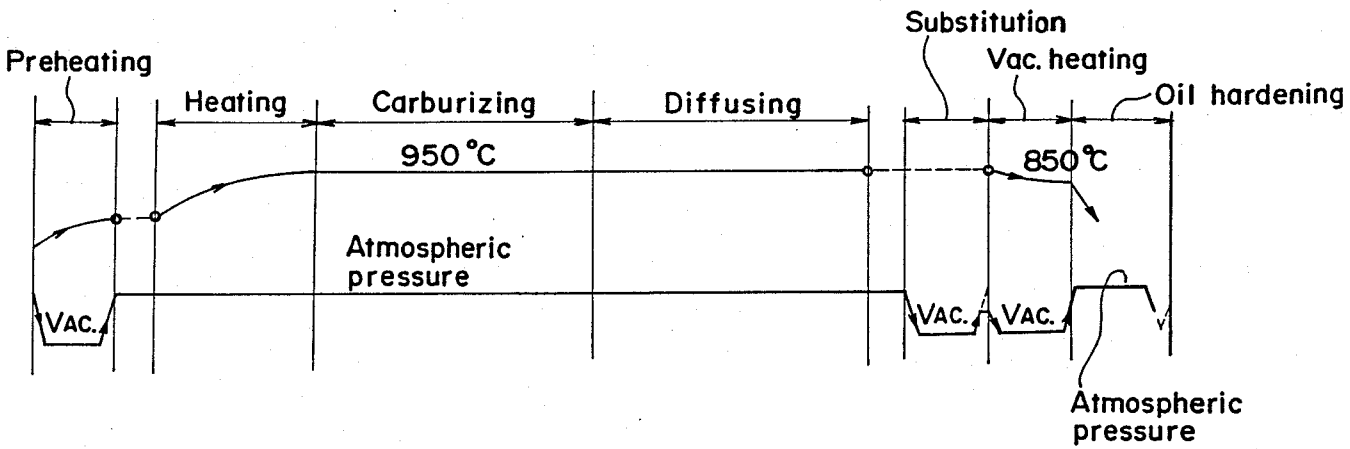
Fig. 7a
Fig. 7b

METHOD OF GAS CARBURIZING AND HARDENING

This is a continuation of applicatioin Ser. No. 686,207, filed Dec. 26, 1984, now abandoned.

BACKGROUND OF THE INVENTION

The present invention generally relates to heat treatment and more particularly, to a method of gas carburizing and hardening steel articles and a continuous furnace therefor.

It has been conventionally known that processes of gas carburizing and hardening of steel articles comprise a heating step of heating the steel articles to a carburizing temperature, a carburizing step of holding the steel articles in a carburizing atmosphere for a predetermined period of time so as to cause carbon to be absorbed into surfaces of the steel articles, a diffusing step of diffusing the absorbed carbon into the steel articles, and a hardening step of cooling the steel articles so as to harden the steel articles. Meanwhile, the processes of gas carburizing and hardening the steel articles are classified, in accordance with pressures in furnaces at the carburizing step and the diffusing step, into a gas carburizing and hardening method in which the steel articles are heat treated in the vicinity of atmospheric pressure by using an endothermic atmosphere or a mixture of $N_2$ gas and a hydrocarbon gas, and a vacuum carburizing and hardening method in which the steel articles are heat treated at subatmospheric pressure by using a mixture of $N_2$ gas and a hydrocarbon gas or the hydrocarbon gas only. The gas carburizing and hardening method has such an advantage as to enable a continuous furnance to have a simple construction but is disadvantageous not only in that the processed steel articles assume so-called carburizing colors such as a grayish brown color, a grayish black color, etc. but in that a quenching media becomes rapidly deteriorated, thereby resulting in a short life thereof. On the other hand, in the vacuum carburizing and hardening method, the steel articles have bright surfaces without assuming the carburizing colors and the quenching media has a long life. However, the vacuum carburizing and hardening method has such an inconvenience that since a plurality of chambers each separated by a vacuum partition door from one another are required to be provided in order to produce a continuous furnace, the continuous furnace becomes complicated in structure.

Meanwhile, the above described carburizing colors are produced by chromic oxides formed on the surfaces of the processed articles during the gas carburizing process or soot adhering to the surfaces of the processed articles during the gas carburizing process. It is known that when an article having a carburizing color is heated at about 900° C. in a vacuum of $10^{-1}$ to $10^{-2}$ torr, dissociation of oxygen is effected due to drop in partial pressure of oxygen such that the processed article has a bright surface.

SUMMARY OF THE INVENTION

Accordingly, an essential object of the present invention is to provide an improved method of gas carburizing and hardening a steel article and an improved continuous furnace therefor, by which the processed article has a bright surface and is reduced in amount of intergranular oxidation layers, with substantial elimination of the disadvantages inherent in conventional methods and continuous furnaces of ths kind.

In accomplishing these and other objects according to one preferred embodiment of the present invention, there is provided an improved method of gas carurizing and hardening a steel article, comprising the steps of: carburizing said steel article in a carburizing atmosphere at atmospheric pressure; heating said steel article in a vacuum for a predetermined period of time; and hardening said steel article.

In accordance with the present invention, since the advantages of the prior art two methods, i.e. the advantages of the gas carburizing and hardening method and the vacuum carburizing and hardening method are combined, the steel articles can be continuously heat treated in aerobic conditions.

BRIEF DESCRIPTION OF THE DRAWINGS

These and other objects and features of the present invention will become apparent from the following description taken in conjunction with the preferred embodiment thererof with reference to the accompanying drawings, in which:

FIG. 6 is a view similar to FIG. 1, particularly showing a continuous furnace according to a second embodiment if the present invention; and FIGS. 7*a* and 7*b* are graphs indicative of temperature and pressure in the chambers of the continuous furnace of FIG. 6, respectively.

Before the description of the present invention proceeds, it is to be noted that like parts are designated by like reference numerals throughout several views of the accompanying drawings.

DETAILED DESCRIPTION OF THE INVENTION

Figure 1:
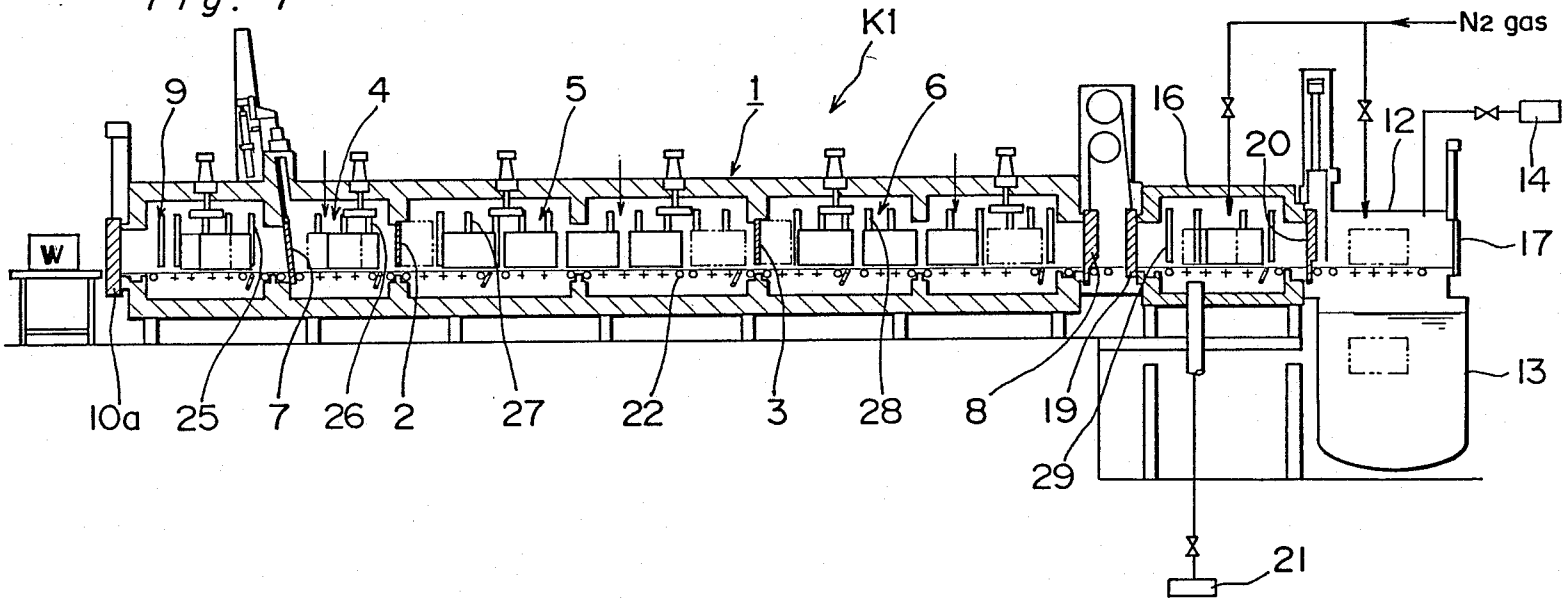
FIG. 1 is a schematic vertical sectional view of a continuous furnance including a plurality of chambers, according to a first embodiment of the present invention.
Figure 2:
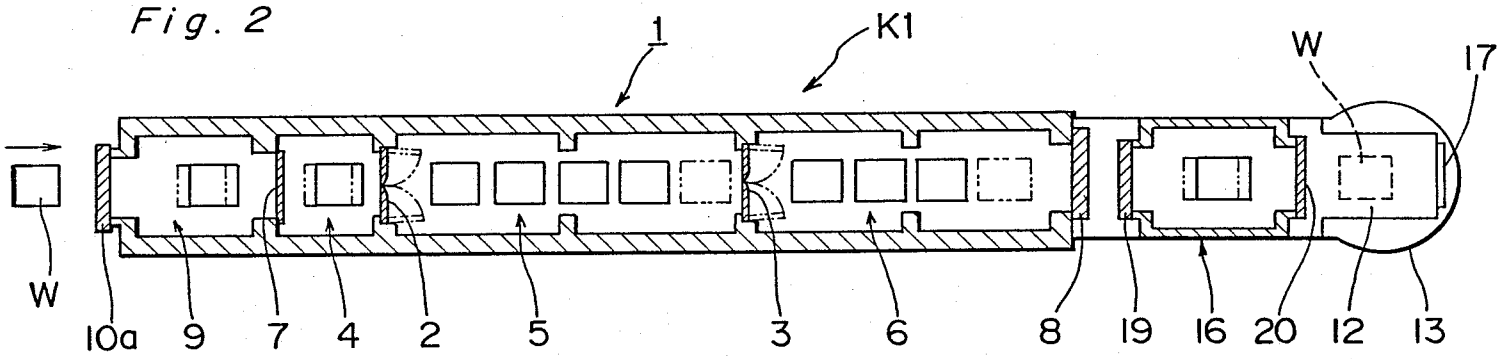
FIG. 2 is a schematic horizontal sectional view of the continuous furnace of FIG. 1.
Figure 3:
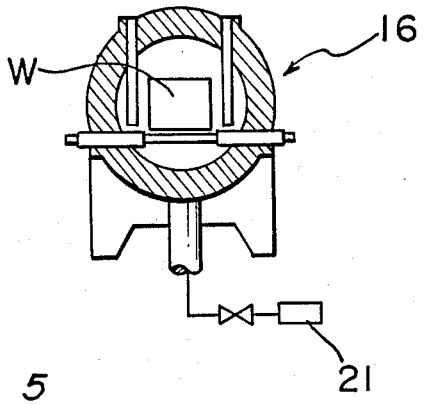
FIG. 3 is a cross-sectional view of a vacuum heating chamber employed in the continuous furnace of FIG. 1.

Referring now to the drawings, there is shown in FIGS. 1 to 3, a continuous furnace K1 for continuously gas carburizing and hardening metal articles W, according to a first embodiment of the present invention. The continuous furnance K1 includes a carburizing apparatus 1, a vacuum heating chamber 16 and a hardening apparatus 12 provided with an oil quenching tank 13 and an elevator (not shown), which are longitudinally arranged in this order. The carburizing apparatus 1 includes a loading vestibule 9 having a loading door 10*a*, a heating chamber 4, a carburizing chamber 5 and a diffusing chamber 6 having a discharge door 8, which are longitudinally arranged in this order. Partition doors 7, 2 and 3 are, respectively, provided between the loading vestibule 9 and the heating chamber 4, between the heating chamber 4 and the carburizing chamber 5 and between the carburizing chamber 5 and the diffusing chamber 6. Either an endothermic gas composed of 20 to 25% by volume of CO and 30 to 40% by volume of $H_2$ or $N_2$ gas is introduced into the heating chamber 4, while a carburizing atmosphere, which is a mixture of a hydrocarbon gas (e.g. propane) and either one of the above endothermic gas and $N_2$ gas, is introduced into the carburizing chamber 5 and the diffusing chamber 6. The hardening apparatus 12 is provided with a discharge door 17, while the vacuum heating chamber 16 is provided with a loading door 19 and a discharge door 20 so as to be coupled with the hardening apparatus 12.

Meanwhile, the hardening apparatus 12 is connected with an evacuation device 14, while the vacuum heating chamber 16 is connected with an evacuation device 21. It is so arranged that $N_2$ gas is supplied into the hardening apparatus 12 and the vacuum heating chamber 16. Furthermore, the continuous furnace K1 includes rollers 22 for conveying the articles W. The loading vestibule 9, heating chamber 4, carburizing chamber 5, diffusing chamber 6 and vacuum heating chamber 16, except for the hardening apparatus 12, are provided with heating devices 25, 26, 27, 28 and 29, respectively.

Figure 5:
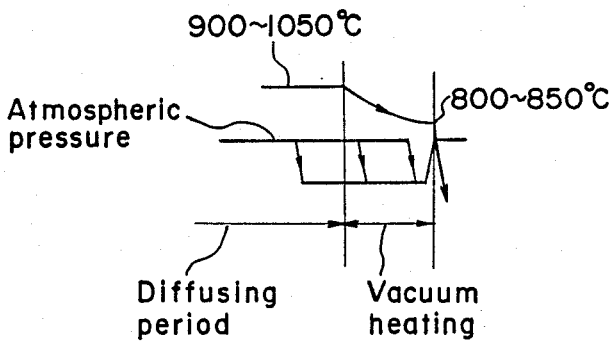
FIG. 5 is a graph showing temperature and pressure in the vacuum heating chamber of FIG. 3.

Hereinbelow, operations of the continuous furnace K1 will be described with reference to FIGS. 4 and 5. FIGS. 4*d* and 4*e* show temperature and pressure in the chambers of the continuous furnace K1, respectively.

EXAMPLE 1

A round rod made of chromium steel SCr415 (JIS) and a gear made of chromium steel SCr420 (JIS) are employed as the articles W and are treated on the following conditions.

(1) Carburizing process
  (1) Carburizing temperature=930° C.
  (2) Carburizing period
    a. Carbon potential=1.1%
    b. Processing time period=105 min.
  (3) Diffusing period
    a. Carbon potential=0.8%
    b. Processing time period=45 min.

(2) Vacuum heating process

After the diffusing process, the articles W are held in a vacuum of $10^{-2}$ torr at a furnace temperature of 930° C. for 30 min.

(3) Hardening process

The articles W are subjected to oil quenching directly from the carburizing temperature of 930° C.

The results of the above treatment are as follows.

The round rod made of SCr415 and the gear made of SCr420 have bright surfaces and are formed with intergranular oxidation layers of 4 to 8 microns in thickness.

EXAMPLE 2

A round rod made of SCr415 and a gear made of SCr420 are employed as the articles W in the same manner as in the above Example 1 and are treated on the following conditions.

(1) Carburizing process
  (1) Carburizing temperature=930° C.
  (2) Carburizing period
    a. Carbon potential=1.1%
    b. Processing time period=105 min.
  (3) Diffusing period
    a. Carbon potential=0.8%
    b. Processing time periodz=45 min.

(2) Vacuum heating process

The articles W are held in a vacuum of $10^{-2}$ torr for 30 min. during which temperature of the articles W drops to a hardening temperature of 850° C. after the diffusing process.

(3) Hardening process

The articles W are subjected to oil quenching immediately after the temperature of the articles W has dropped to the hardening temperature of 850° C.

The results of the above treatment are as follows.

The round rod made of SCr415 and the gear made of SCr420 have bright surfaces and are formed with intergranular oxidation layers of 5 to 10 microns in thickness.

EXAMPLE 3

A round rod made of chromium molybednum steel SCM420H (JIS) is employed as the article W and is treated on the following conditions.

(1) Carburizing process
  (1) Carburizing temperature=930° C.
  (2) Carburizing period
    a. Carbon potential=1.1%
    b. Processing time period=120 min.

(2)Vacuum heating process

The article W is held in a vacuum of $5\times10^{-2}$ torr not only for a diffusing period of 30 min. after the carburizing period but for 20 min. during which temperature of the article W drops to a hardening temperature of 850° C. after the diffusing process.

(3) Hardening process

The article W is subjected to oil quenching immediately after the temperature of the article W has dropped to the hardening temperature of 850° C.

The results of the above treatment are as follows.

The round rod made of SCM420H has a bright surface and is formed with abnormal surface structure (troostitic layers) of not more than 5 microns in thickness.

COMPARATIVE EXAMPLE

When the articles W are not subjected to the vacuum heating process in the above Examples 1 to 3, namely the articles W are subjected to the oil hardening process directly after the diffusing process, the articles W have the carburizing colors such as grayish brown color, grayish black color, etc. and are formed with intergranular oxidation layers of 15 to 20 microns in thickness.

Figures 4A, 4B, 4C, 4D, 4E:
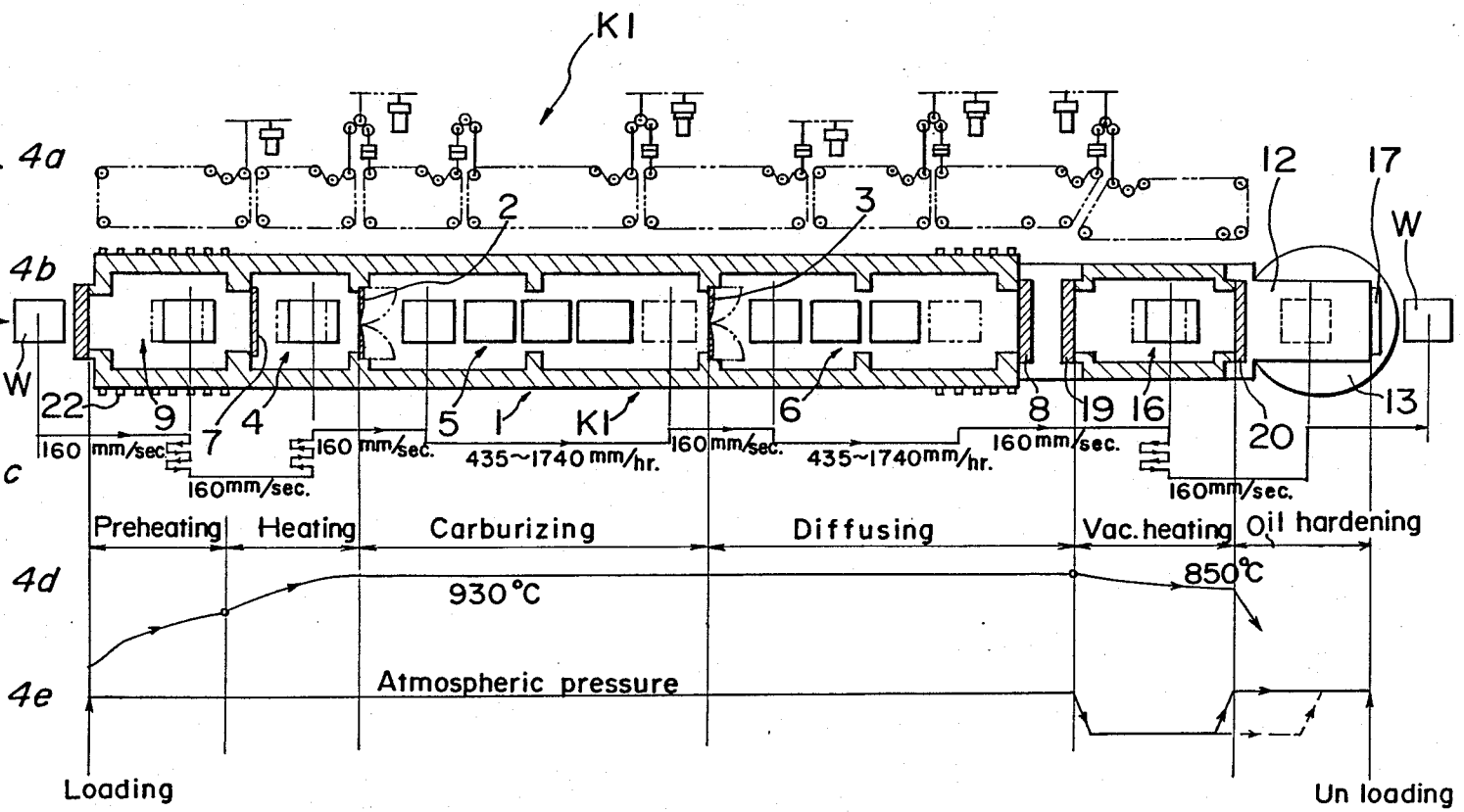
FIG. 4*a* is a schematic view of a plurality of drive units for driving rollers for conveying steel articles, which are employed in the continuous furnance of FIG. 1.
FIG. 4*b* is a view similar to FIG. 2, particularly showing the rollers driven by the driving units of FIG. 4*a;*
FIG. 4*c* is a chart indicative of transfer speed and path of the steel articles at the respective chambers.
FIGS. 4*d* and 4*e* are graphs showing temperature and pressure in the chambers of the continuous furnace of FIG. 1, respectively.

As shown in FIG. 4*a*, the continuous furnace K1 includes a plurality of drive units for driving the rollers 22 for conveying the articles W. Each of the articles W is conveyed by the drive units at different speeds in the furnace K1 so as to be oscillated in a path of the articles W as shown in FIG. 4*c*. In the furnace K1, it is so arranged that as soon as the article W has been loaded into the vacuum heating chamber 16, the vacuum heating chamber 16 is evacuated to a vacuum by the evacuation device 21 as shown in FIG. 4*e*. However, it was found that the articles W have bright surfaces and are formed with decreased intergranular oxidation layers even in the case where the vacuum heating chamber 16 is evacuated to a vacuum in the course of drop of temperature therein during the vacuum heating process or after drop of the temperature of the articles W to the hardening temperature of 850° C., or prior to drop of the temperature of the articles W to the hardening temperature, e.g. the vacuum heating chamber 16 is evacuated to a vacuum during the diffusing period such that part of the diffusing process is performed in the vacuum heating chamber 16 as shown in FIG. 5. Namely, in the case where the temperature of the articles W is lowered to the hardening temperature after the carburizing process, a decision as to when the vacuum heating process is started is made in accordance with amount of the articles W to be treated and piling conditions of the articles W. Meanwhile, in the case where the articles W are subjected to the hardening process immediately after the carburizing process, the articles W are subjected to the vacuum heating process during a latter part of the diffusing period.

It is to be noted that the hardening apparatus 12 is not limited to the oil quenching apparatus but a gas cooling apparatus can be employed as the hardening apparatus 12 in place of the oil quenching apparatus. Furthermore, the hardening apparatus 12 is not necessarily required to be provided with the evacuation device 14. However, when the hardening apparatus 12 is provided with the evacuation device 14 such that a controlled atmosphere of $N_2$ gas is introduced into the hardening apparatus 12 after the hardening apparatus 12 has been evacuated to a vacuum, the amount of the controlled atmosphere or $N_2$ gas drawn into the hardening apparatus 12 is less than that in the case of purging the interior of the hardening apparatus 12 with the controlled atmosphere, thus resulting in a more economical operation.

Referring to FIG. 6, there is shown a continuous furnace K2 according to a second embodiment of the present invention. The continuous furnace K2 includes the loading vestibule 9 having the loading door 10*a* and a discharge door 10*b*, the carburizing apparatus 1 provided separately from the loading vestibule 9, a purge chamber 15 having a loading door 18, the vacuum heating chamber 16 and the hardening device 12 provided with the oil quenching tank 13. The carburizing apparatus 1 includes the heating chamber 4 having a loading door 7', a carburizing zone 5' and a diffusing zone 6'. The continuous furnace K2 includes the partition door 2 for separating the heating chamber 4 from the carburizing zone 5' as in the continuous furnace K1 but is not provided with the partition door 3 of the continuous furnace K1 for separating the carburizing zone 5' from the diffusing zone 6'. the loading vestibule 9 is connected with an evacuation device 11. The purge chamber 15 is coupled, through the vacuum heating chamber 16, with the hardening apparatus 12. The purge chamber 15 and the vacuum heating chamber 16 are connected with the evacuation device 21. Since other constructions of the continuous furnace K2 are similar to those of the continuous furnace K1, detailed description thereof is abbreviated for the sake of brevity.

Hereinbelow, operations of the continuous furnace K2 will be described with reference to FIGS. 7*a* and 7*b* showing temperature and pressure in the chambers of the continuous furnace K2, respectively. After the article W made of chromium molybdenum steel SCM420 (JIS), etc. has been loaded into the loading vestibule 9, the evacuation device 11 is actuated so as to evacuate the loading vestibule 9 to a vacuum and, at the same time, the aritcle W is preheated to temperatures of 400° to 600° C. by a heating device (not shown) so as to remove from the article W impurities adhering thereto. After the article W has been preheated, $N_2$ gas is introduced into the loading vestibule 9 so as to restore the interior of the loading vestibule 9 to atmospheric pressure. Subsequently, teh article W is loaded into the heating chamber 4 by opening the discharge door 10*b* of the loading vestibule 9 and the loading door 7' of the carburizing apparatus 1. After the article W has been heated to a carburizing temperature of about 950° C. by a heating device (not shown) in the heating chamber 4, the article W is sequentially subjected to the carburizing process in the carburizing zone 5' and the diffusing process in the diffusing zone 6'. The carburizing process is performed at a carbon potential of 1.0% for 150 min., while the diffusing process is performed at a carbon potential of 0.9% for 90 min.

Thus, when the carburizing process and the diffusing process have been completed, the article W is conveyed into the purge chamber 15 by opening the discharge door 8 of the carburizing apparatus 1 and the loading door 18 of the purge chamber 15. Then, the discharge door 8 and the loading door 18 are closed. When the article W has been transported into the purge chamber 15, the interior of the purge chamber 15 and the vacuum heating chamber 16 is maintained at a vacuum of about $10^{-2}$ torr by the evacuation device 21. Thereafter, the article W is loaded into the vacuum heating chamber 16 by opening the loading door 19 of the heating chamber 16 so as to be held in a vacuum of about $10^{-2}$ torr in the vacuum heating chamber 16 for about 30 min. until the temperature of the article W drops to the oil quenching temperature of, for example, 850° C. Meanwhile, the hardening apparatus 12 is evacuated to a vacuum of about $10^{-2}$ torr by the evacuation device 14. When the temperature of the article W has dropped to the hardening temperature in the vacuum heating chamber 16, $N_2$ gas is directed into the vacuum heating chamber 16 and the hardening apparatus 12 so as to restore the interior of the vacuum heating chamber 16 and the hardening apparatus 12 substantially to atmospheric pressure. Subsequently, teh article W is loaded into the hardening apparatus 12 by opening the discharge door 20 of the vacuum heating chamber 16. Then, the article W is subjected to oil quenching by dipping the article W into oil in the oil quenching tank 13 by the use of the elevator (not shown). After completion of the oil quenching, the article W is carried out of the hardening appartus 12 by opening the discharge door 17 of the hardening apparatus 12, whereby the carburizing process and the hardening process of the article W have been completed.

Although the loading vestibule 9 is provided with the evacuation device 11 in the continuous furnace K2, it can be also so arranged that, by eliminating the evacuation device 11, the interior of the loading vestibule 9 is purged with a protective controlled atmosphere of the above described carburizing atmosphere after the article W has been loaded into the loading vestibule 9. However, when the loading vestibule 9 is provided with the evacuation device 11 as in the continuous furnace K2, the amount of the controlled atmosphere required therefor becomes small, thereby making the carburizing process less expensive.

Furthermore, the purge chamber 15 is not necessarily required to be provided in the continuous furnace K2. In any case, by heating the gas carburized article W in the vacuum heating chamber 16, the article W has a bright surface and is formed with decreased intergranular oxidation layers through dissociation of $O_2$.

As is clear from the foregoing description, in accordance with the method of the present invention, since the vacuum heating process is provided between the carburizing process and the hardening process which are performed at atmospheric pressure, production of the carburizing colors associated with the gas carburizing and hardening method is prevented, so that the treated articles have bright surfaces and are formed with decreased intergranular oxidation layers without employing the vacuum carburizing and hardening method and the continuous furnace can be simplified in structure.

Moreover, in accordance with the continuous furnace of the present invention, since the vacuum heating chamber is provided between the carburizing apparatus and the hardening apparatus and the hardening apparatus is connected with the evacuation device, the continuous furnace has been simplified in structure and lowered in cost as compared with continuous furnaces for vacuum carburizing and hardening.

In addition, in accordance with the present invention, it is possible to continuously gas carburize and harden the articles such that the articles have bright surfaces similar, in color, to the material without assuming the carburizing colors and are formed with decreased intergranular oxidation layers which ensure high wear resistance and high durability of the articles.

Furthermore, in accordance with the present invention, even in the case where the articles are subjected to oil hardening, soot does not adhere to the surfaces of the articles due to the vacuum heating process in the vacuum heating chamber, thus resulting in long life of the quenching media.

Moreover, in accordance with the present invention, in the case where the loading vestibule is evacuated to a vacuum by the evacuation device, a required amount of the controlled atmosphere becomes small, so that operations of the continuous furnace are economical, while entry of air into the carburizing apparatus is prevented by the loading vestibule and the vacuum heating chamber such that seasoning of the articles can be performed at an early stage.

In addition, in accordance with the present invention, since the loading vestibule is provided with the evacuation device and the heating device, it becomes unnecessary to provide a washing device prior to treatment of the articles.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. A method of gas carburizing and hardening a steel article, having an initial heating step of heating said steel article under atmospheric conditions to a carburizing temperature of said steel article, and comprising:

(a) a carburizing step of holding said heated steel article at the carburizing temperature in a carburizing atmosphere at atmospheric pressure to form a desired carburized layer on the surface of said steel article;

(b) separating said carburizing step into an atmospheric carburizing period and an atmospheric diffusing period;

(c) employing a carburizing atmosphere including CO, $CO_2$, $H_2$ and $H_2O$ maintained at first and second predetermined carbon potentials during said carburizing period and said diffusing period, respectively, said atmosphere creating oxides in chromium and manganese ingredients in said steel article;

(d) vacuum heating said steel article for at least 20 minutes in a vacuum held at a temperature corresponding to a hardening temperature of said steel article after said diffusing period for dissociating oxygen from chromium oxide and manganese oxide of said steel article; and (e) a hardening step of cooling said steel article at atmospheric pressure to form a carburized non-discolored case on the surface of said steel article.

2. A method as claimed in claim 1, wherein the carburizing temperature ranges from 900° to 1050° C. and the temperature of said vacuum heating step ranges from 800° to 850° C.

3. A method of gas carburizing and hardening a steel article, comprising:

(a) an initial heating step of heating said steel article under atmospheric pressure to a carburizing temperature of said steel article;

(b) a carburizing step at atmospheric pressure for forming a desired carburized layer on the surface of said steel article;

(c) dividing said carburizing step into a first carburizing period and a second diffusing period path at atmospheric pressure;

(d) heating said steel article in said carburizing atmosphere at the carburizing temperature during said carburizing period and also during an initial part of said second diffusing period;

(e) employing a carburizing atmosphere including CO, $CO_2$, $H_2$ and $H_2O$ maintained at first and second predetermined carbon potentials at atmospheric pressure during said carburizing period and during the initial half of said diffusing period, respectively, which carburizing atmosphere creates chromium and manganese oxides in the steel article being carburized;

(f) holding said steel article heated to the carburizing temperature in a vacuum during a latter portion of said diffusing period so as to be subjected to not only a diffusing process but also to dissociation of oxygen from chromium oxide and manganese oxide of said steel article, with the latter portion of said diffusing period covering at least 20 min.; and (g) a hardening step of cooling said steel article so as to form a uniformly-clored carburized case on the surface of said steel article.

* * * * *